US008113511B2

(12) United States Patent
Kallin et al.

(10) Patent No.: US 8,113,511 B2
(45) Date of Patent: Feb. 14, 2012

(54) DOCUMENT DESKEWING MODULE WITH A MOVING TRACK BOTTOM AND METHODS OF OPERATING A DOCUMENT DESKEWING MODULE

(75) Inventors: Fredrik L. N. Kallin, Waterloo (CA); Robert J. Ross, Waterloo (CA)

(73) Assignee: NCR Corporation, Duluth, GA (US)

( * ) Notice: Subject to any disclaimer, the term of this patent is extended or adjusted under 35 U.S.C. 154(b) by 132 days.

(21) Appl. No.: 12/570,487

(22) Filed: Sep. 30, 2009

(65) Prior Publication Data

US 2011/0074099 A1 Mar. 31, 2011

(51) Int. Cl.
*B65H 7/02* (2006.01)

(52) U.S. Cl. ..... 271/228; 271/251

(58) Field of Classification Search ..... 271/228, 271/248, 251, 250, 273
See application file for complete search history.

(56) References Cited

U.S. PATENT DOCUMENTS

| | | | | |
|---|---|---|---|---|
| 4,764,976 | A * | 8/1988 | Kallin et al. | 382/321 |
| 6,715,755 | B2 * | 4/2004 | Sussmeier | 271/251 |
| 2003/0080185 | A1 * | 5/2003 | Werther | 235/380 |
| 2009/0091075 | A1 * | 4/2009 | Yasumoto | 271/250 |

FOREIGN PATENT DOCUMENTS

JP 05043092 A * 2/1993

* cited by examiner

*Primary Examiner* — Michael McCullough
(74) *Attorney, Agent, or Firm* — Michael Chan

(57) ABSTRACT

A document deskewing module comprises a set of sensors arranged to detect when a document transported in a first direction of document travel along a document transport path is deskewed, a first set of drive rollers in the form of hard drive rollers disposed along the document transport path, a first set of idler rollers moveable towards and away from the hard drive rollers, a second set of drive rollers in the form of soft drive rollers disposed along the document transport path, a second set of idler rollers moveable towards and away from the soft drive rollers, a track bottom disposed on one side of the document transport path and movable in the first direction of document travel, and a controller arranged to control operation of the first and second sets of idler rollers and the movable track bottom.

10 Claims, 13 Drawing Sheets

DOCUMENT DESKEWING MODULE WITH A MOVING TRACK BOTTOM AND METHODS OF OPERATING A DOCUMENT DESKEWING MODULE

BACKGROUND

The present invention relates to self-service document depositing terminals, and is particularly directed to a document deskewing module with a moving track bottom for use in a self-service bunch document depositing terminal, such as a bunch document depositing automated teller machine (ATM), and methods of operating such a deskewing module.

In a typical bunch document depositing ATM, an ATM customer is allowed to deposit a bunch of documents of the same type such as currency notes or checks (without having to place any of the documents in a deposit envelope) in a publicly accessible, unattended environment. To deposit a bunch of documents, the ATM customer inserts a user identification card through a user card slot at the ATM, enters the amount of the bunch of documents being deposited, and inserts the bunch of documents to be deposited through a slot of a bunch document acceptor. A document transport mechanism receives the inserted bunch of documents and then separates and transports the documents one-by-one in a forward direction along a document transport path to a number of locations within the ATM to process the documents.

If a particular document is not accepted for deposit, the document transport mechanism transports the entire bunch of documents in a manner to return the bunch of documents to the ATM customer. If the entire bunch of documents is accepted for deposit, the amount of the bunch of documents is deposited into the ATM customer's account and the documents are transported one-by one to a number of storage bins within the ATM. If a bunch of documents is a bunch of checks, an endorser printer prints an endorsement onto each check as the check is being transported to and stored in a check storage bin. If a bunch of documents is a bunch of currency notes, then each currency note is transported to and stored in a currency storage bin. Documents in the different storage bins within the ATM are periodically picked up and physically transported via courier to a back office facility of a financial institution for further processing.

After the documents are separated from the bunch, they need to be deskewed before continuing down the document transport path. It is desirable to deskew the skewed document before it is processed at the different locations within the ATM to improve image-based recognition rates, to improve magnetic read rates, to print the proper print zones, and to reduce document jam rates.

Document deskewing modules for use in ATMs are known. However, these known document deskewing modules are designed to deskew only one type of document (e.g., either a currency note or a check, but not both). When a document deskewing module is designed to deskew only one type of document, the module is usually effective in deskewing a document of only that particular type. This is because different types of documents are of different sizes, different thicknesses, different paper grades, or the like, for examples.

Moreover, known document deskewing modules may have difficulty deskewing certain currency notes because of condition of these currency notes. For example, a "limp" currency note is usually difficult to transport along the document transport path as well as to deskew while being transported along the document transport path. This is because a leading front corner of the limp note may curl excessively when the corner makes contact with a track bottom of the document transport path as the currency note is being deskewed. When the corner of the note curls excessively, the corner may bunch up and cause a document jam condition. It would be desirable to provide a document deskewing module which is effective to deskew a relatively non-stiff document, such as a limp currency note, without having the document curl and bunch up as the document is being deskewed.

SUMMARY

In accordance with one embodiment of the present invention, a document deskewing module is provided for a self-service bunch document depositing terminal. The document deskewing module comprises a set of sensors arranged to detect when a document transported in a first direction of document travel along a document transport path is deskewed, a first set of drive rollers in the form of hard drive rollers disposed along the document transport path, a first set of idler rollers moveable towards and away from the hard drive rollers, a second set of drive rollers in the form of soft drive rollers disposed along the document transport path, a second set of idler rollers moveable towards and away from the soft drive rollers, a track bottom disposed on one side of the document transport path and movable in the first direction of document travel, and a controller arranged to (i) control operation of the first and second sets of idler rollers in response to a number of signals from the set of sensors such that a deskewed document is moved in a second direction of document travel which is transverse to the first direction of document travel, and (ii) control operation of the movable track bottom such that a leading front corner of the deskewed document is moved in the first direction of document travel when the corner moves into contact with the track bottom as the document is moving in the second direction of document travel so as to reduce tendency of the corner of the document from curling and thereby to reduce tendency of the corner from bunching up and causing a document jam condition.

DETAILED DESCRIPTION

The present invention is directed to a document deskewing module with a moving track bottom for use in a for a self-service bunch document depositing terminal, such as a bunch document depositing automated teller machine (ATM), and methods of operating such a deskewing module.

Figure 1:
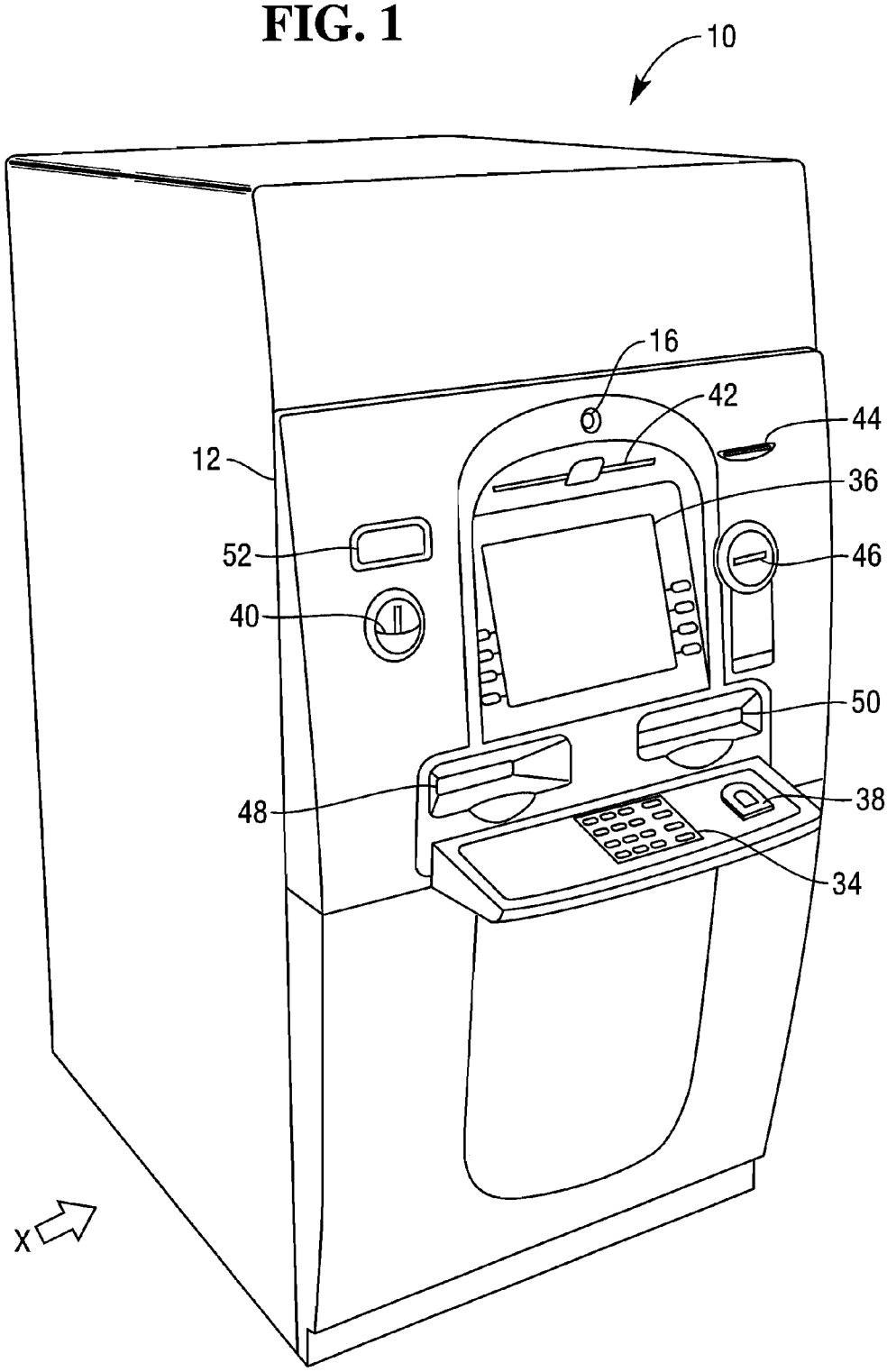
FIG. 1 is a left-front perspective view of a bunch document depositing automated teller machine (ATM) constructed in accordance with one embodiment of the present invention.

Referring to FIG. 1, a self-service bunch document depositing terminal in the form of an image-based bunch document depositing automated teller machine (ATM) 10 is illustrated. The check depositing ATM 10 comprises a fascia 12 coupled to a chassis (not shown). The fascia 12 defines an aperture 16 through which a camera (not shown) images a customer of the ATM 10. The fascia 12 also defines a number of slots for receiving and dispensing media items, and a tray 40 into which coins can be dispensed. The slots include a statement output slot 42, a receipt slot 44, a card reader slot 46, a cash slot 48, another cash slot 50, and a bunch document input/output slot 52. The slots 42 to 52 and tray 40 are arranged such that the slots and tray align with corresponding ATM modules mounted within the chassis of the ATM 10.

The fascia 12 provides a user interface for allowing an ATM customer to execute a transaction. The fascia 12 includes an encrypting keyboard 34 for allowing an ATM customer to enter transaction details. A display 36 is provided for presenting screens to an ATM customer. A fingerprint reader 38 is provided for reading a fingerprint of an ATM customer to identify the ATM customer. The user interface features described above are all provided on an NCR PERSONAS (trademark) 6676 ATM, available from NCR Financial Solutions Group Limited, Discovery Centre, 3 Fulton Road, Dundee, DD2 4SW, Scotland.

Figure 2:
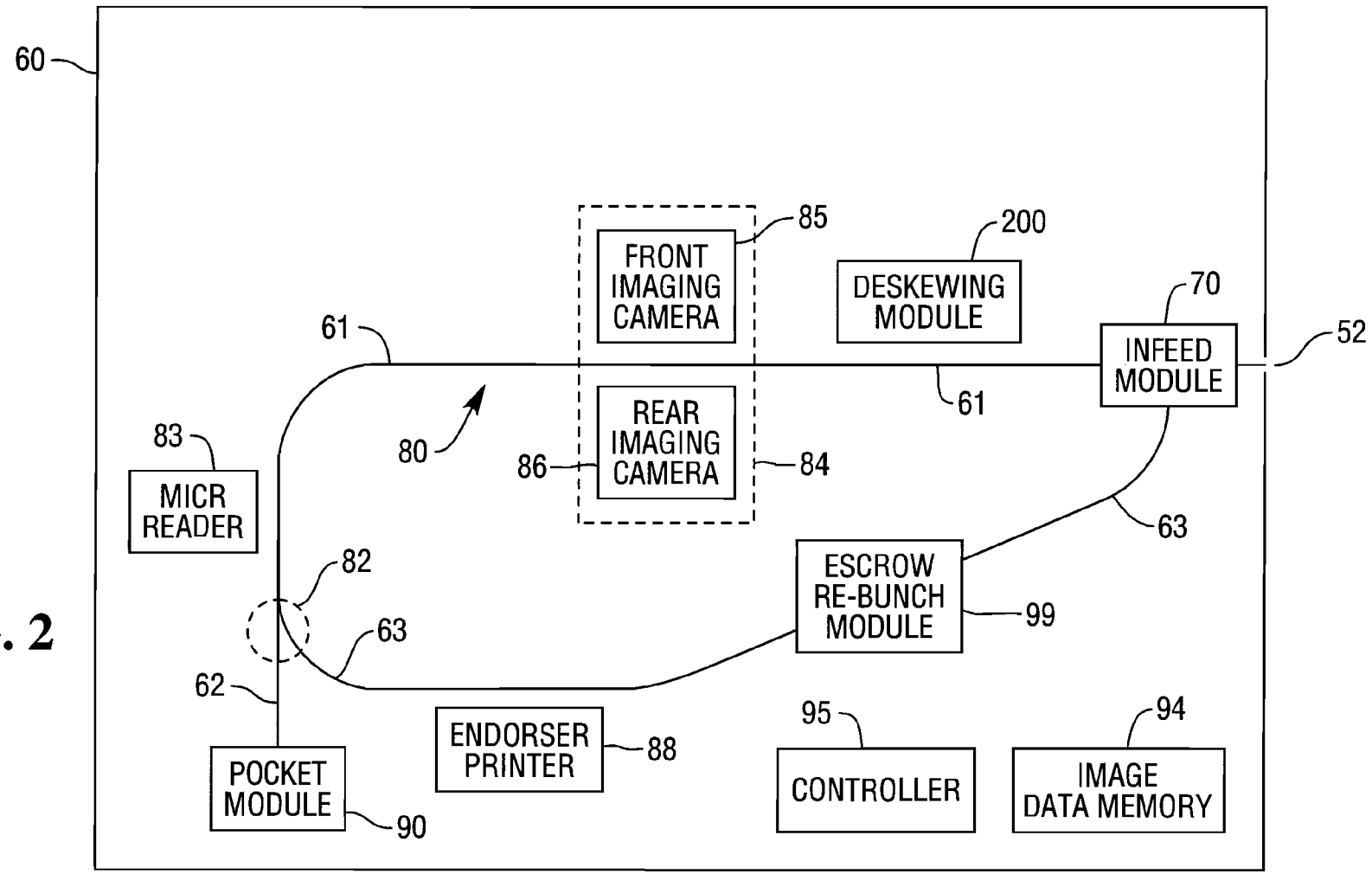
FIG. 2 is a simplified schematic diagram, looking approximately in the direction of arrow X in FIG. 1, and illustrating a scalable deposit module (SDM) configured to operate in the ATM of FIG. 1.
Figure 3:
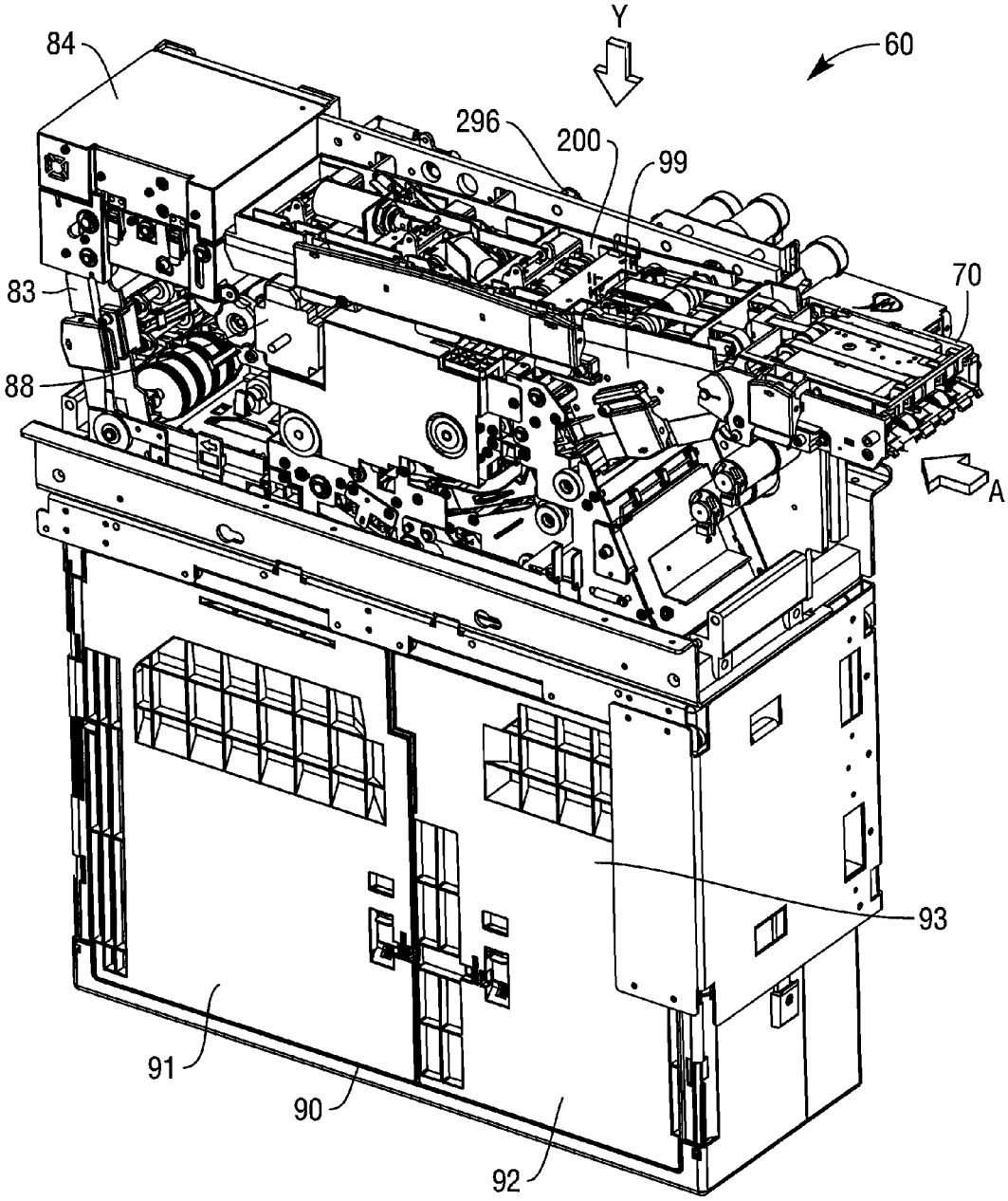
FIG. 3 is a left-front perspective view of the SDM of FIG. 2.

Referring to FIGS. 2 and 3, one embodiment of a scalable deposit module (SDM) 60 is illustrated. FIG. 2 is a simplified schematic diagram (looking approximately in the direction of arrow X in FIG. 1) of part of the fascia 12 and main parts of the SDM 60. FIG. 3 is a left-front perspective view of the SDM 60 shown in FIG. 2.

The SDM 60 of FIGS. 2 and 3 comprises five main units which include an infeed module 70, a transport module 80, a pocket module 90, an escrow re-bunch module (ERBM) 99, and a document deskewing module 200. The infeed module 70 receives a bunch of documents deposited into the bunch document input/output slot 52, and transports the documents one-by-one to an inlet of the transport module 80. The dimensions of the infeed module 70, such as its run length, may vary depending upon the particular model ATM the SDM 60 is installed. The structure and operation of the infeed module 70 are conventional and well known and, therefore, will not be described.

The transport module 80 includes a document transport mechanism which receives a document from the inlet adjacent to the infeed module 70, and transports the document along a first document track portion 61 which is the main track portion. The transport module 80 further includes a document diverter 82 which is operable to divert a document along a second document track portion 62 to the pocket module 90, and a third document track portion 63 which leads to the ERBM 99 and then back to the infeed module 70. The third document track 63 allows a bunch of documents which has accumulated in the ERBM 99 to be transported back to the infeed module 70. The structure and operation of diverter 82 shown in FIG. 2 may be any suitable diverter which is capable of diverting a document along one of two different document transport paths. The structure and operation of diverter 82 are conventional and well known and, therefore, will not be described.

The transport module 80 further includes a magnetic ink character recognition (MICR) head 83 for reading magnetic details on a code line of a check. The transport module 80 also includes an imager 84 including a front imaging camera 85 and a rear imaging camera 86 for capturing an image of each side of a check (front and rear). An endorser printer 88 is provided for printing endorsements onto checks. An image data memory 94 is provided for storing images of checks. A controller 95 is provided for controlling the operation of the elements within the SDM 60.

The pocket module 90 includes a check storage bin 91 (FIG. 3) for storing processed checks. The pocket module 90 further includes a currency storage bin 92 for storing processed currency notes. The pocket module 90 also includes a reject bin 93 for storing rejected documents. The structure and operation of the pocket module 90 are conventional and well known and, therefore, will not be described.

The SDM 60 processes a bunch of documents of different types (such as currency notes, checks, or a combination thereof). When a bunch of documents is being processed, each document of the bunch is separated at the infeed module 70 before it is individually processed. Each processed document is then re-assembled at the ERBM 99 to bunch the documents back together. Bunch processing of different types of documents is sometimes referred to as "multiple-document processing". Since individual documents are being bunched back together, an escrow module (such as the ERBM 99 shown in FIGS. 2 and 3) is needed. The ERBM 99 is manufactured and available from Glory Products, located in Himeji, Japan. The ERBM 99 allows a bunch of documents to be processed in a single transaction. If a bunch of documents has accumulated in the ERBM 99 and is unable to be processed further within the SDM 60, then the bunch of documents is transported via the third document track portion 63 back to the infeed module 70 to return the unprocessed bunch of documents to the ATM customer.

Figure 4:
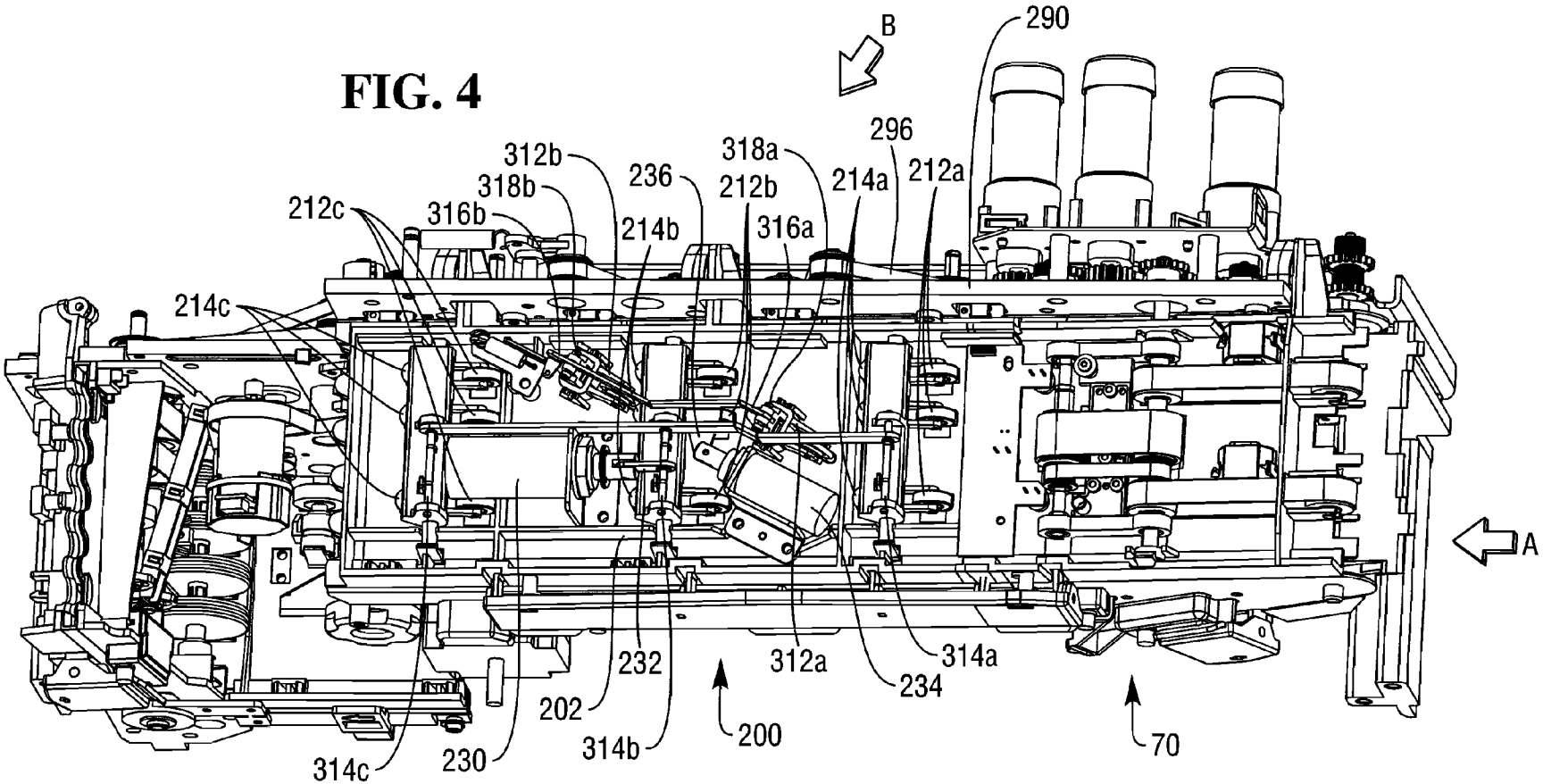
FIG. 4 is a top perspective view, looking approximately in the direction of arrow Y in FIG. 3.
Figure 5:
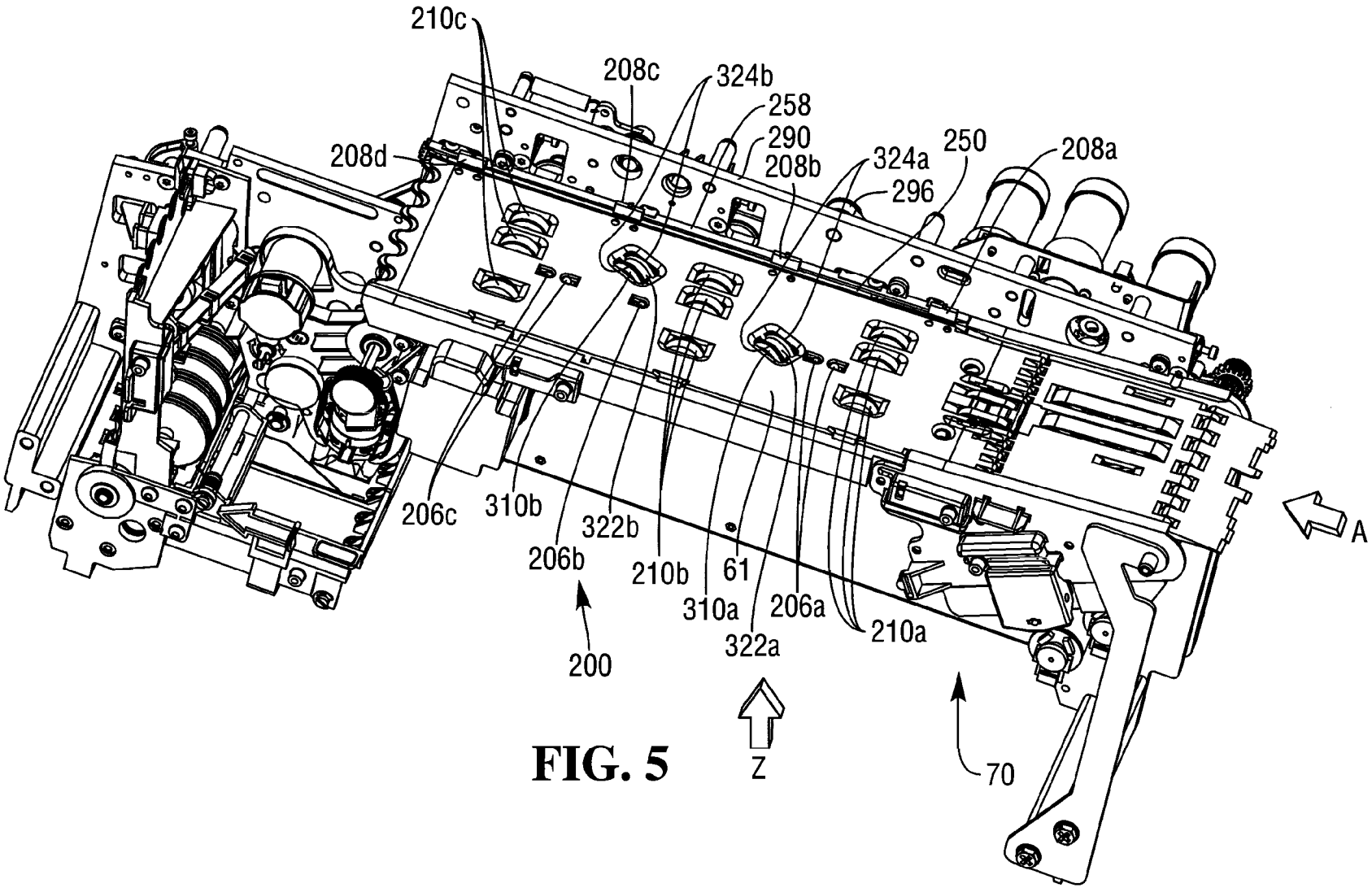
FIG. 5 is a view similar to the top perspective view of FIG. 4, with some parts removed to better illustrate parts of a document deskewing module constructed in accordance with one embodiment of the present invention.
Figure 6:
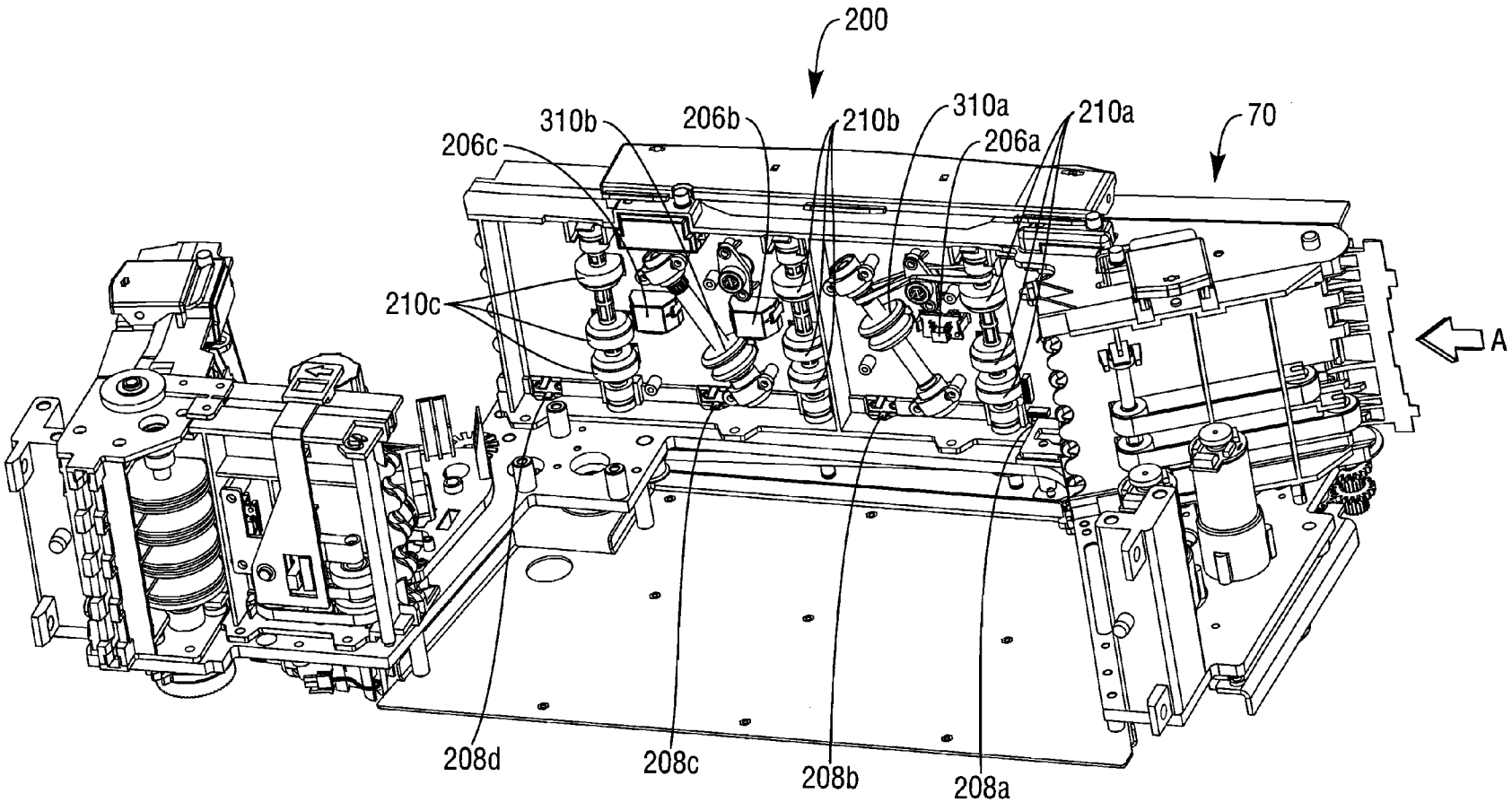
FIG. 6 is a bottom perspective view, looking approximately in the direction of arrow Z shown in FIG. 5.

Referring to FIGS. 4, 5, and 6, the document deskewing module 200 includes a top guide assembly 202 (FIG. 4) which guides a document in the direction of arrow A along the first document track portion 61 (FIG. 5). FIG. 4 is a top perspective view, looking approximately in the direction of arrow Y in FIG. 3. FIG. 5 is a view similar to the top perspective view of FIG. 4, with some parts including the top guide assembly 202 removed to better illustrate certain parts of the document deskewing module 200. FIG. 6 is a bottom view, looking approximately in the direction of arrow Z shown in FIG. 5.

As shown in FIG. 5, the document deskewing module 200 includes a moving track bottom mechanism 250 which provides a relatively straight reference surface or edge against which a document abuts as the document is being transported along the first document track portion 61 in the direction of arrow A. This reference surface or edge is referred to herein as the track bottom. Structure and operation of one embodiment of the moving track bottom mechanism 250 will be described later hereinbelow.

A first set of track sensors 206*a*, 206*b*, 206*c* detects progress of the document as the document is being transported from an upstream end of the first document track portion 61 to a downstream end of the first document track portion. A second set of track sensors 208*a*, 208*b*, 208*c*, 208*d* detects when the document has been deskewed in a manner to be described hereinbelow.

A first set of drive rollers 210*a*, 210*b*, 210*c* (FIG. 5) cooperates with a first set of idler rollers 212*a*, 212*b*, 212*c* (FIG. 4) to advance the document downstream along the first document track portion 61. The first set of drive rollers 210*a*, 210*b*, 210*c* operate in direct contact with the opposing idlers 212*a*, 212*b*, 212*c* giving a large drive force and is referred to herein as the hard drive rollers. The first set of idler rollers 212*a*, 212*b*, 212*c* is referred to herein as the hard drive idlers. The hard drive rollers 210*a*, 210*b*, 210*c* lie "parallel" to the direction of document movement as indicated by arrow A shown in FIG. 5. A set of compression springs 214*a*, 214*b*, 214*c* (FIG. 4) maintains the set of hard drive idlers 212*a*, 212*b*, 212*c* in contact with the opposing set of hard drive rollers 210*a*, 210*b*, 210*c*. A first set of lifter arms 314*a*, 314*b*, 314*c* allows the set of hard drive idlers 212*a*, 212*b*, 212*c* to be disengaged from the set of hard drive rollers 210*a*, 210*b*, 210*c*, in a manner to be described later herein.

A second set of drive rollers 310*a*, 310*b* (FIG. 5) cooperates with a second set of idler rollers 312*a*, 312*b* (FIG. 4) to direct the document against the track bottom. The second set of drive rollers 310*a*, 310*b* do not contact the opposing idlers 312*a*, 312*b* directly while operating giving a much lighter drive force and is referred to herein as the soft drive rollers. The second set of idler rollers 312*a*, 312*b* is referred to herein as the soft drive idlers. The soft drive rollers 310*a*, 310*b* are "angled" relative to the hard drive rollers 210*a*, 210*b*, 210*c* as shown in FIG. 5. Accordingly, the soft drive rollers 310*a*, 310*b*, 310*c* lie "angled" to the direction of document movement as indicated by arrow A shown in FIG. 5. A second set of lifter arms 316*a*, 316*b* allows the set of soft drive idlers 312*a*, 312*b* to move away from the set of soft drive rollers 310*a*, 310*b*, in a manner to be described later herein.

As shown in FIG. 5, each of the soft drive rollers 310*a*, 310*b* has a corresponding one of U-shaped depressions 322*a*, 322*b*. The U-shaped depression 322*a* is associated with the soft drive roller 310*a* and is disposed between a pair of tire surfaces 324*a* of the soft drive roller 310*a*. The corresponding soft drive idler 312*a* (FIG. 4) runs inside the U-shaped depression 322*a* of the soft drive roller 310*a*, and does not contact soft drive roller 310*a*. Similarly, the U-shaped depression 322*b* is associated with the soft drive roller 310*b* and is disposed between a pair of tire surfaces 324*b* of the soft drive roller 310*b*. The corresponding soft drive idler 312*b* (FIG. 4) runs inside the U-shaped depression 322*b* of the soft drive roller 310*b*, and does not contact soft drive roller 310*b*. A corresponding set of adjustment screws 318*a*, 318*b* allows the positions of the set of soft drive idlers 312*a*, 312*b* to be adjusted relative to the positions of the set of soft drive rollers 310*a*, 310*b*.

Cooperation between the soft drive roller 310*a* and the soft drive idler 312*a* and cooperation between the soft drive roller 310*b* and the soft drive idler 312*b* are the same. For simplicity, only cooperation between the soft drive roller 310*a* and the soft drive idler 312*a* will be described hereinbelow.

When a document is transported along the first document track portion 61 and moves between the soft drive roller 310*a* and the soft drive idler 312*a*, the soft drive idler deflects the document into the U-shaped depression 322*a*. The amount of drive force from the tire surfaces 324*a* acting on the document depends upon the amount of deflection force from the document. The amount of deflection force from the document depends upon the extent to which the soft drive idler 312*a* is running inside of the U-shaped depression 322*a* (as determined by position of the adjustment screw 318*a*).

The amount of deflection force from the document also depends upon the relative stiffness (or relative limpness) of the particular document. For example, a relative stiffer document provides a greater amount of deflection force and, therefore, provides a greater amount of drive force (from the tire surfaces 324*a*) which acts on the document. Similarly, a relative limper document provides a lesser amount of deflection force and, therefore, provides a lesser amount of drive force (from the tire surfaces 324*a*) which acts on the document. The angle of the tire surfaces 324*a* relative to the direction of travel (as indicated by arrow A) of document causes the document to abut against the track bottom.

It should be apparent that the cooperation between the soft drive roller 310*a* and the soft drive idler 312*a* provides a variable drive force which acts on the document being transported along the first document track portion 61. The variable drive force provided is such that relatively thicker or stiffer documents are driven harder, and relatively thinner or limper documents are driven more lightly. This variable drive force is advantageous because (i) a relatively thicker or stiffer document (such as one that has been folded, curled or crumpled) requires more drive force to overcome the friction of travelling down the first document track portion 61, and (ii) a relatively thinner or limper document is less likely to deform as the document is more lightly pushed against the track bottom.

A first actuatable solenoid 230 (FIG. 4) having an armature link 232 is operatively coupled through the first set of lifter arms 314*a*, 314*b*, 314*c* to the hard drive idlers 212*a*, 212*b*, 212*c*. A second actuatable solenoid 234 having an armature link 236 is operatively coupled through the second set of lifter arms 316*a*, 316*b* to the soft drive idlers 312*a*, 312*b*. When the first solenoid 230 is actuated, the hard drive idlers 212*a*, 212*b*, 212*c* are moved away from the hard drive rollers 210*a*, 210*b*, 210*c*. At the same time, the second solenoid 234 is actuated and the soft drive idlers 312*a*, 312*b* are moved towards and running inside the U-shaped depressions 322*a*, 322*b* of the soft drive rollers 310*a*, 310*b*.

When the first solenoid 230 is de-actuated, the armature link 232 releases the first set of lifter arms 314*a*, 314*b*, 314*c*. At the same time, the second solenoid 234 is de-actuated and the second set of lifter arms 316*a*, 316*b* are lifted. These two actions cause the hard drive idlers 212*a*, 212*b*, 212*c* to engage the hard drive rollers 210*a*, 210*b*, 210*c*, and at the same time, the soft drive idlers 312*a*, 312*b* to move away from or "disengage" the soft drive rollers 310*a*, 310*b*. Accordingly, only one function of either hard drive rollers 210*a*, 210*b*, 210*c* or the soft drive rollers 310*a*, 310*b* is normally provided at any one time.

When a document first comes out the infeed module 70, the document encounters the soft drive rollers 310*a*, 310*b* and the soft drive idlers 312*a*, 312*b* (i.e., the function of the soft drive rollers 310*a*, 310*b* is provided). The soft drive rollers 310*a*, 310*b* and the soft drive idlers 312*a*, 312*b* push the document against the track bottom until at least two of the deskew sensors 208*a*, 208*b*, 208*c*, 208*d* are blocked. When at least two of the deskew sensors 208*a*, 208*b*, 208*c*, 208*d* are blocked, the second solenoid 234 is de-actuated to "disengage" the soft drive rollers 310*a*, 310*b* and the solenoid 230 is de-actuated to engage the hard drive rollers 210*a*, 210*b* 210*c*.

It should be noted that the soft drive rollers 310*a*, 310*b* need to be disengaged at this point. Otherwise, a relative thin or limp document will begin to curl and jam if it travels any significant distance with the angled soft drive rollers 310*a*, 310*b* engaged. The document is now deskewed and is transported to other parts of the SDM 60 under control of the hard drive rollers 210*a*, 210*b*, 210*c*.

By using a document deskewing module as described hereinabove, it is conceivable that the hard drive rollers 210*a*, 210*b*, 210*c* be momentarily engaged if the document is detected to hesitate while under control of the soft drive rollers 310*a*, 310*b*. This momentary engagement of the hard drive rollers 210*a*, 210*b*, 210*c* would act as a small "nudge" or "kick" to the document in an attempt to correct what is causing the document to hesitate.

Figure 7:
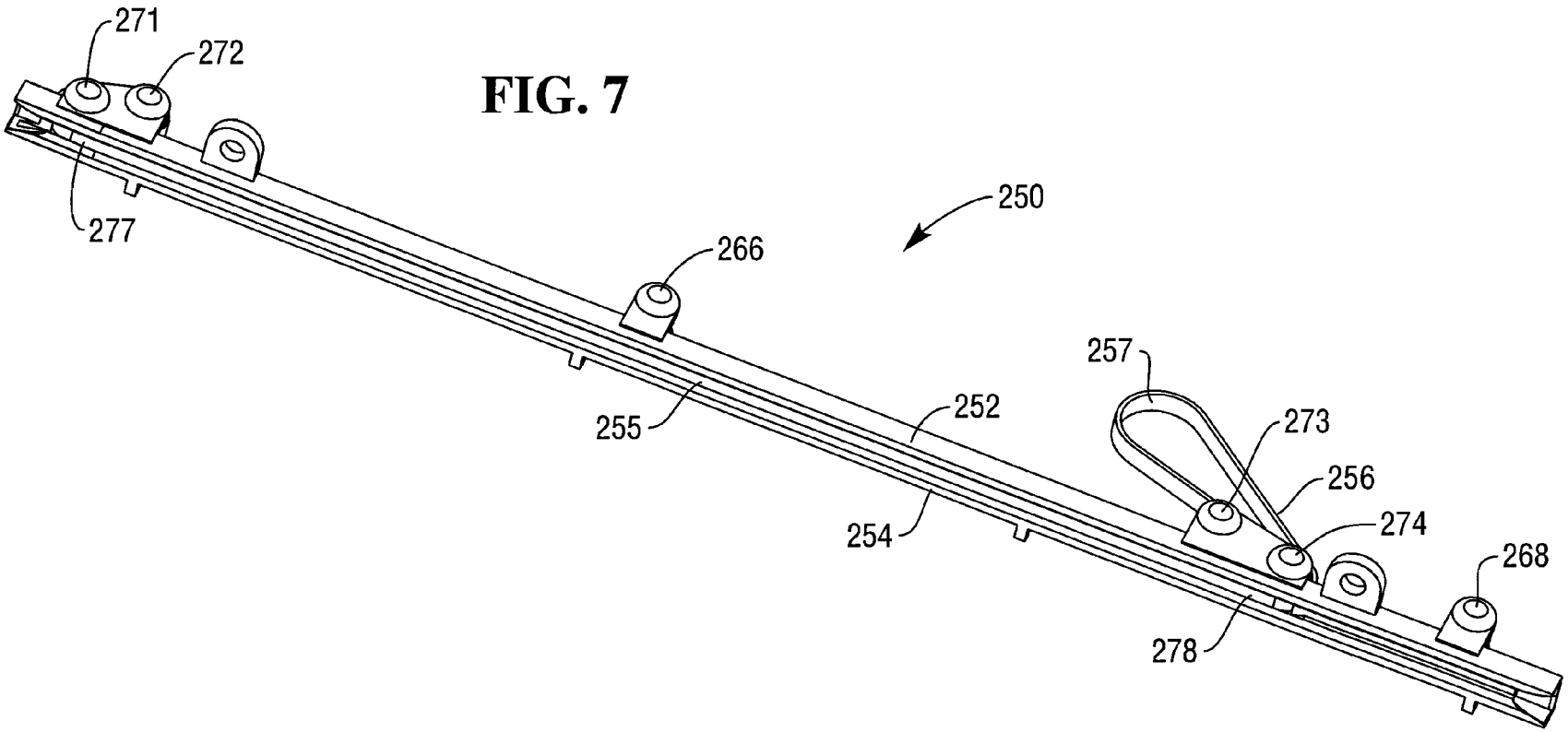
FIG. 7 is a enlarged view of certain components of a moving track bottom mechanism shown in FIG. 5.
Figure 8:
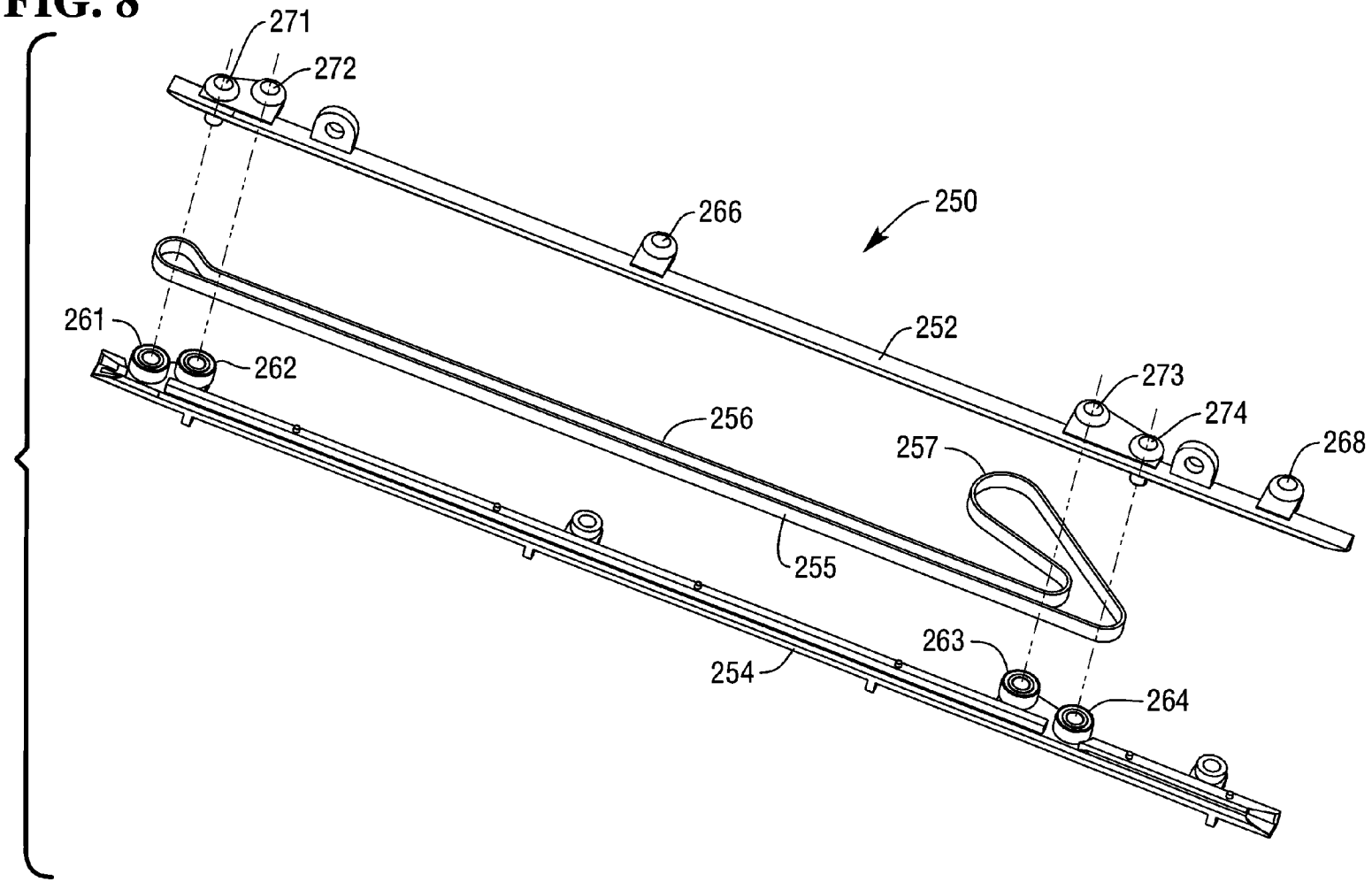
FIG. 8 is an exploded view of components shown in FIG. 7.
Figure 9:
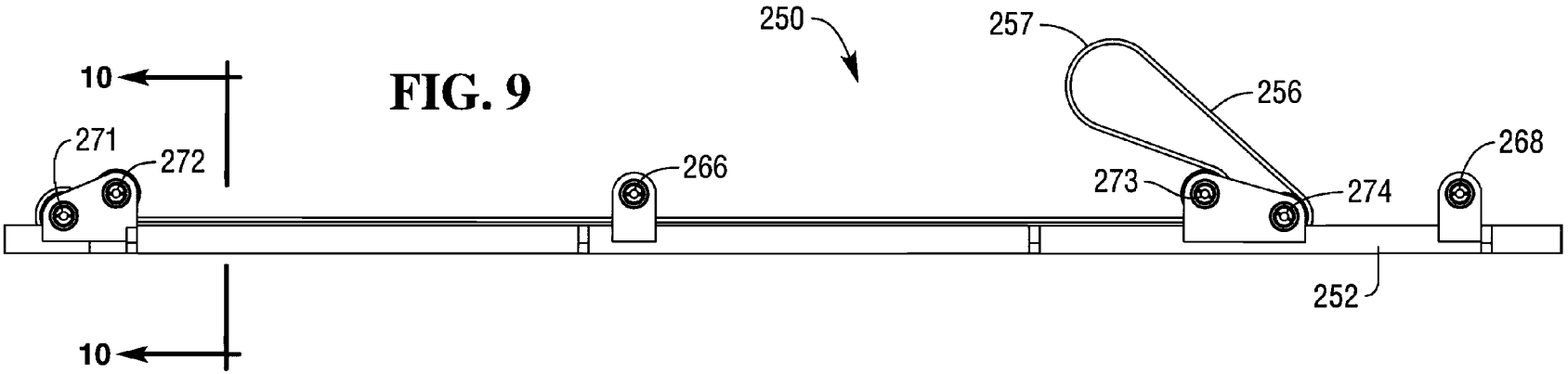
FIG. 9 is an elevational view of components shown in FIG. 7.
Figure 10:
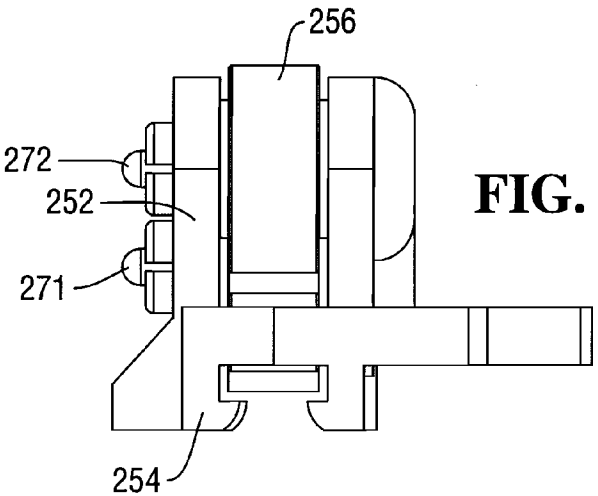
FIG. 10 is sectional view taken approximately along line 10-10 of FIG. 9.

Referring to FIG. 7, an enlarged view of components of the moving track bottom mechanism 250 is illustrated. An exploded view of the components shown in FIG. 7 is illustrated in FIG. 8. Further, FIG. 9 is an elevational view of the components shown in FIG. 7, and FIG. 10 is sectional view taken approximately along line 10-10 of FIG. 9.

As best shown in FIG. 8, the moving track bottom mechanism 250 comprises two split half portions 252, 254 and a continuous endless belt 256 which is held between the two split half portions. More specifically, the belt 256 is routed around a set of four roller-shaped bearing surfaces 261, 262, 263, 264 disposed on the one half portion 254. The belt 256 has an outer circumferential surface 255, and forms a bight portion 257. A set of four plastic rivet studs 271, 272, 273, 274 disposed on the other half portion 252 is coupled to the set of four roller-shaped bearing surfaces 261, 262, 263, 264 to maintain the belt 256 sandwiched between the two split half portions 252, 254. The outer circumferential surface 255 of the belt 256 is exposed through a substantially rectangular opening between the two body portions. A pair of plastic rivet studs 266, 268 provides additional strength to hold the split half portions 252, 254 together.

Figure 11:
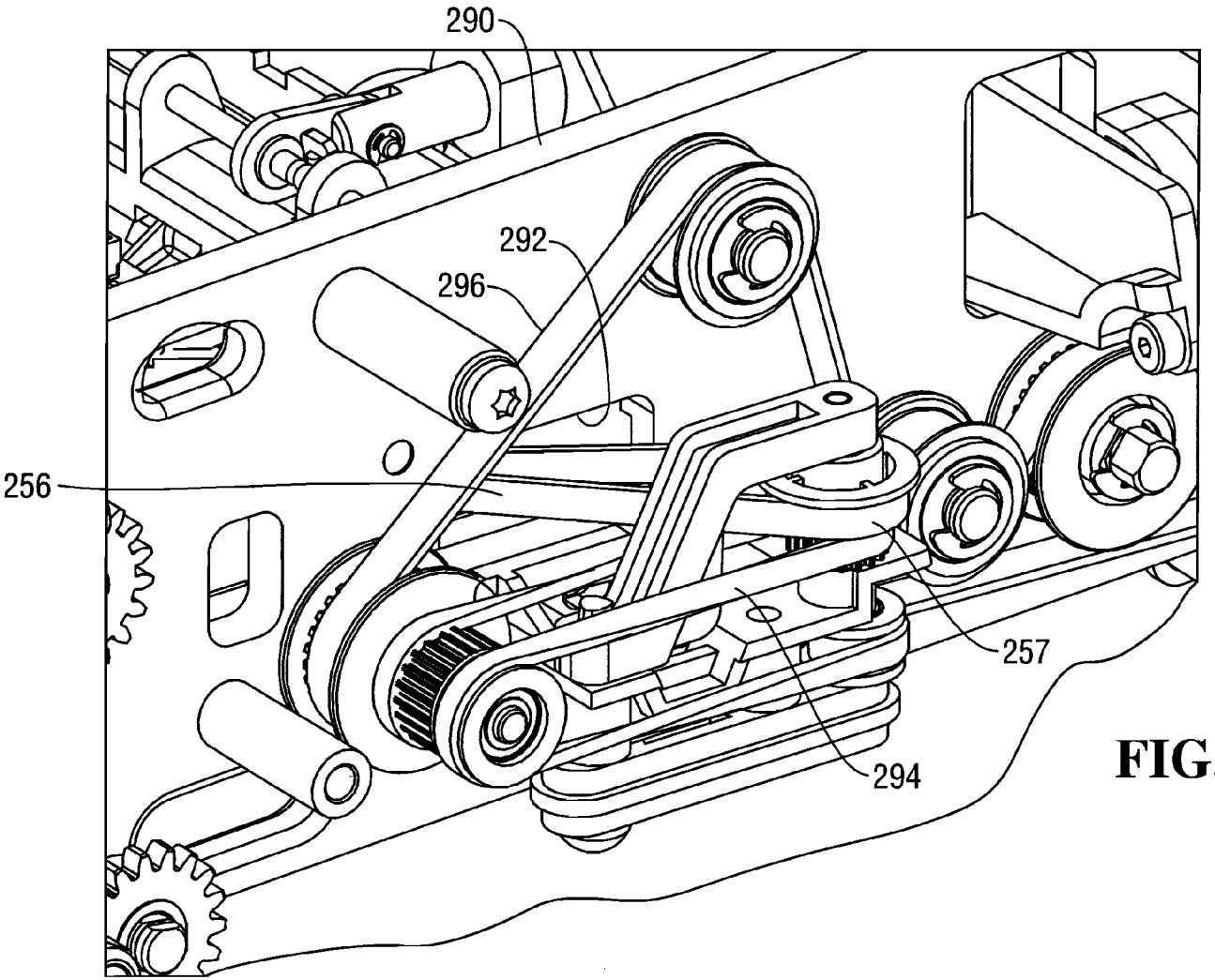
FIG. 11 is a perspective view, looking approximately in the direction of arrow B shown in FIG. 4, of an enlarged view of the moving track bottom mechanism of FIG. 7 being mechanically coupled to other components of the document deskewing module.

Referring to FIG. 11, the bight portion 257 of the belt 256 passes through an opening 292 of a sidewall portion 290 of the document deskewing module 200. The belt 256 is driven by a twisted belt 294 which, in turn, is driven by a main transport belt 296. It should be noted that a small portion of the main transport belt 296 is shown in each of FIGS. 3, 4, and 5. The main transport belt 296 is operatively coupled through a number of different gears and other belts to a main drive motor (not shown) which provides the main drive for the document deskewing module 200.

Figure 12:
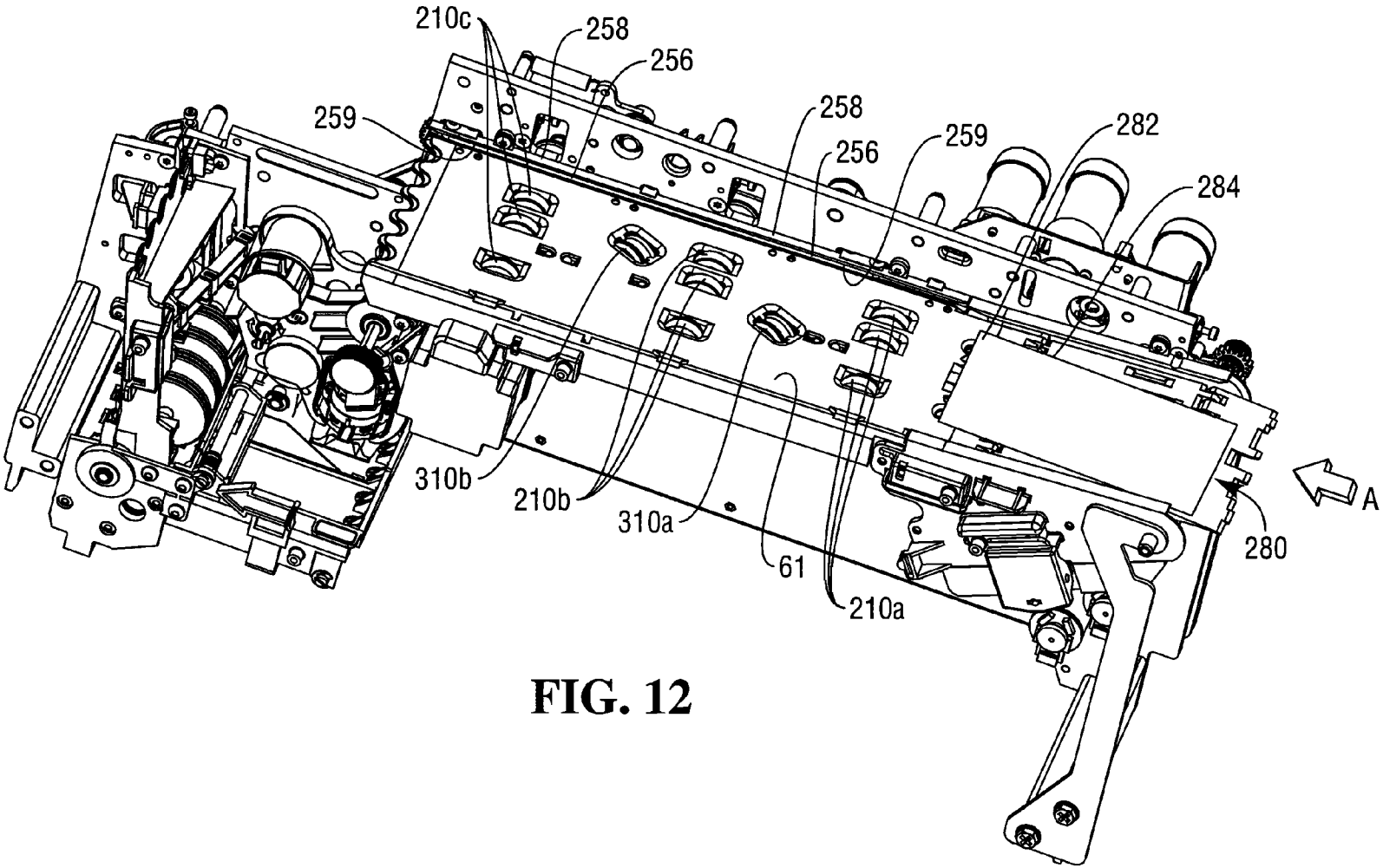
FIG. 12 is a perspective view similar to FIG. 5, and showing a skewed document being transported along a document transport path.

Referring to FIG. 12, the outer circumferential surface 255 of the belt 256 is exposed through a channeled opening 259 which extends along the length of a baseplate portion 258 of the document deskewing module 200. Accordingly, as best shown in FIG. 7, the outer circumferential surface 255 of the belt 256 from approximately the location at reference numeral 277 to the location at reference numeral 278 is exposed through the channeled opening 259 shown in FIG. 12. It should be noted that the second set of track sensors 208*a*, 208*b*, 208*c*, 208*d* are not shown in FIG. 12 so that other parts can be more easily seen. The belt 256 is driven in a direction such that the outer circumferential surface of the belt 256 moves in the same direction of movement as a document moving downstream along the first document track portion 61.

Also, as shown in FIG. 12, a document 280 is skewed and is moving from upstream to downstream in the forward direction of document travel along the first document track portion 61. The skewed document 280 has a leading front corner portion 282 and a long edge portion 284. As the document 280 continues to move downstream from the position shown in FIG. 12 to the position shown in FIG. 13, the driving forces of the hard drive rollers 210*a* and the soft drive roller 310*a* causes the corner portion 282 of the document 280 to move into contact with the moving outer circumferential surface 255 of the belt 256.

Figure 13:
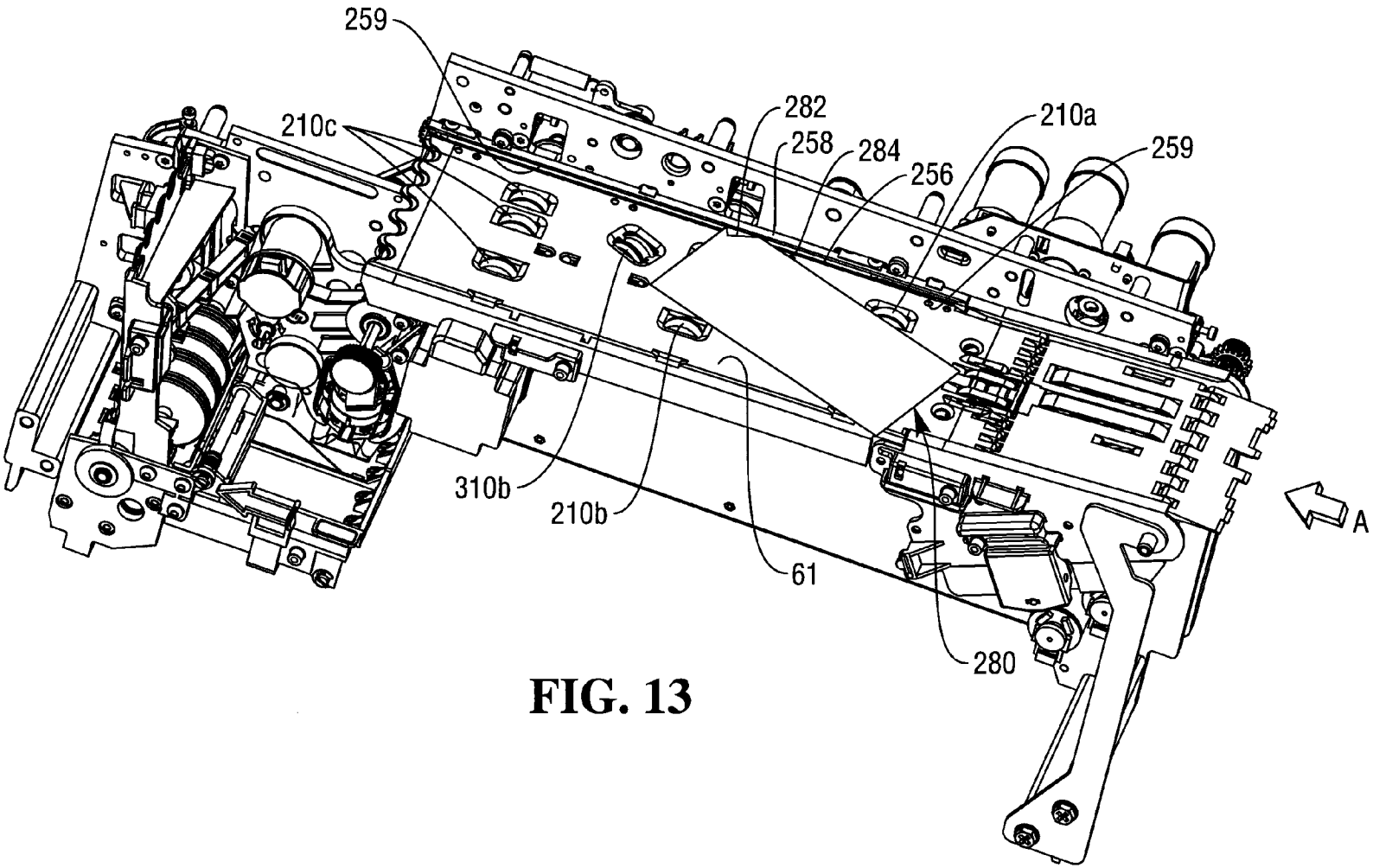
FIG. 13 is a perspective view similar to FIG. 12, and showing the document at another position along the document transport path and contacting the moving track bottom mechanism of FIG. 7.

When contact occurs between the corner portion 282 of the document 280 and the moving outer circumferential surface 255 of the belt 256, the corner portion tends to curl and fold over such as shown in FIG. 13. This tendency to curl and fold over is especially more likely when the document 280 is relatively limp, such as with an old and worn currency note. However, since the moving outer circumferential surface 255 of the belt 256 is moving downstream in the same direction as the document 280 is moving, the tendency of the corner portion 282 to curl and fold over is reduced. Preferably, the moving speed of the outer circumferential surface 255 in the forward direction of document travel is just slightly faster than the moving speed of the document 280 itself in the forward direction of document travel.

Figure 14:
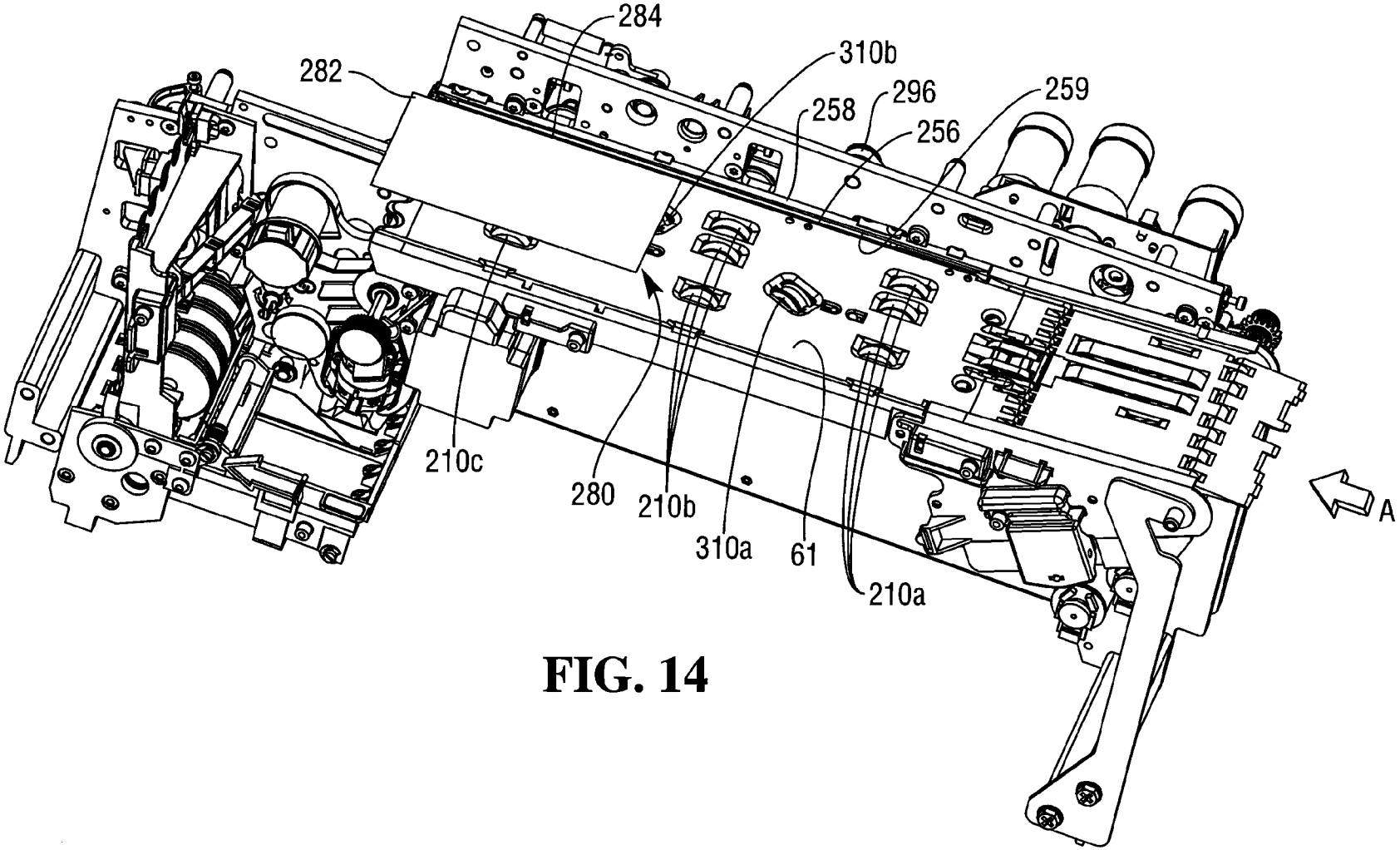
FIG. 14 is a perspective view similar to FIG. 13, and showing the document in yet another position along the document transport path.

As the document 280 continues to move downstream in the forward direction of document travel from the position shown in FIG. 13, the document becomes deskewed such as shown in FIG. 14. As the document 280 deskews while moving from the position shown in FIG. 13 to the position shown in FIG. 14, the corner portion 282 of the document is less likely to curl or fold because of the reduced drag. At the same time, the long edge portion 284 of the document 280 moves into contact with the moving outer circumferential surface 255 of the belt 256.

It should be apparent that the belt 256 provides a moving track bottom which tends to reduce likelihood of the corner portion 282 of the document 280 from bunching up and causing a document jam condition. This is because the moving outer circumferential surface 255 of the belt 256 carries the corner portion 282 of the document 280 in the forward direction of document travel until the long edge portion 284 of the document moves into contact with the moving outer circumferential surface. Since the long edge portion 284 is stiffer than the corner portion 282, the document 280 is able to continue movement in the forward direction of document travel with minimal deformation along the long edge portion.

Although the above description describes the PERSONAS (trademark) 6676 NCR ATM embodying the present invention, it is conceivable that other models of ATMs, other types of ATMs, or other types of self-service bunch document depositing terminals may embody the present invention. Self-service bunch document depositing terminals are generally public-access devices that are designed to allow a user to conduct a bunch document deposit transaction in an unassisted manner and/or in an unattended environment. Self-service bunch document depositing terminals typically include some form of tamper resistance so that they are inherently resilient.

The particular arrangements disclosed are meant to be illustrative only and not limiting as to the scope of the invention. From the above description, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A method of operating a document deskewing module having a document transport path along which a document can be transported, the method comprising:

at a first time, moving a first set of idler rollers towards a first set of drive rollers in the form of hard drive rollers to drive the document between the first set of idler rollers and the hard drive rollers to move the document in a first direction of document travel from an upstream end of the document transport path to a downstream end of the document transport path;

at a second time which is different from the first time, moving a second set of idler rollers towards a second set of drive rollers in the form of soft drive rollers to drive the document between the second set of idler rollers and the soft drive rollers to move the document in a second direction of document travel which is transverse to the first direction of document travel;

at a third time which is after the first and second times, receiving by a movable track bottom a leading front corner of the document as the document is moving in the second direction of document travel and the leading front corner moves into contact with the track bottom; and at a fourth time which is after the third time, moving the track bottom in the first direction of document travel to move the leading front corner in the first direction of document travel so as to reduce tendency of the leading front corner of the document from curling and thereby to reduce tendency of the leading front corner from bunching up and causing a document jam condition;

wherein the leading front corner of the document is moved by the moving track bottom in the first direction of document travel at a speed faster than the speed at which the document is being moved by the hard drive rollers in the first direction of document travel.

2. A method according to claim 1, wherein the second direction of document travel is perpendicular to the first direction of document travel.

3. A method of operating a document deskewing module having a document transport path along which a document can be transported, the method comprising:

at a first time, moving a first set of idler rollers towards a first set of drive rollers in the form of hard drive rollers to drive the document between the first set of idler rollers and the hard drive rollers to move the document in a first direction of document travel from an upstream end of the document transport path to a downstream end of the document transport path;

at a second time which is different from the first time, moving a second set of idler rollers towards a second set of drive rollers in the form of soft drive rollers to drive the document between the second set of idler rollers and the soft drive rollers to move the document in a second direction of document travel which is transverse to the first direction of document travel;

at a third time which is after the first and second times, receiving by an outer circumferential surface of a controllable endless belt a leading front corner of the document as the document is moving in the second direction of document travel and the leading front corner moves into contact with the outer circumferential surface of the endless belt; and at a fourth time which is after the third time, controlling the endless belt to move the outer circumferential surface of the endless belt in the first direction of document travel to move the leading front corner in the first direction of document travel so as to reduce tendency of the leading front corner of the document from curling and thereby to reduce tendency of the leading front corner from bunching up and causing a document jam condition;

wherein the leading front corner of the document is moved by the moving outer circumferential surface of the endless belt in the first direction of document travel at a speed faster than the speed at which the document is being moved by the hard drive rollers in the first direction of document travel.

4. A method according to claim 3, wherein the second direction of document travel is perpendicular to the first direction of document travel.

5. A method of operating a document deskewing module having a document transport path along which a document can be transported, the method comprising:

moving a first set of idler rollers towards a first set of drive rollers to drive the document between the first set of idler rollers and the first set of drive rollers to move the document in a first direction of document travel from an upstream end of the document transport path to a downstream end of the document transport path;

moving a second set of idler rollers towards a second set of drive rollers to drive the document between the second set of idler rollers and the second set of drive rollers to move the document in a second direction of document travel which is transverse to the first direction of document travel;

receiving by an outer circumferential surface of a controllable endless belt a leading front corner of the document as the document is moving in the second direction of document travel and the leading front corner moves into contact with the outer circumferential surface of the endless belt; and controlling the endless belt to move the outer circumferential surface of the endless belt in the first direction of document travel to move the leading front corner in the first direction of document travel at a speed faster than the speed at which the document is being moved by the first set of drive rollers in the first direction of document travel so as to reduce tendency of the leading front corner of the document from curling and thereby to reduce tendency of the leading front corner from bunching up and causing a document jam condition.

6. A method according to claim 5, wherein the second direction of document travel is perpendicular to the first direction of document travel.

7. A document deskewing module for a self-service bunch document depositing terminal, the document deskewing module comprising:

a set of sensors arranged to detect when a document transported in a first direction of document travel along a document transport path is deskewed;

a first set of drive rollers in the form of hard drive rollers disposed along the document transport path;

a first set of idler rollers moveable towards and away from the hard drive rollers;

a second set of drive rollers in the form of soft drive rollers disposed along the document transport path;

a second set of idler rollers moveable towards and away from the soft drive rollers;

a track bottom disposed on one side of the document transport path and movable in the first direction of document travel; and a controller arranged to (i) control operation of the first and second sets of idler rollers in response to a number of signals from the set of sensors such that a deskewed document is moved in a second direction of document travel which is transverse to the first direction of document travel, and (ii) control operation of the movable track bottom such that a leading front corner of the deskewed document is moved in the first direction of document travel when the corner moves into contact with the track bottom as the document is moving in the second direction of document travel so as to reduce tendency of the corner of the document from curling and thereby to reduce tendency of the corner from bunching up and causing a document jam condition;

wherein the leading front corner of the document is moved by the moving track bottom in the first direction of document travel at a speed faster than the speed at which the document is being moved by the hard drive rollers in the first direction of document travel.

8. A document deskewing module according to claim 7, wherein the track bottom comprises an endless continuous belt having an outer circumferential surface against which the corner of the document contacts.

9. A document deskewing module according to claim 8, wherein (i) the track bottom comprises two split half body portions, and (ii) the belt is sandwiched between the two body portions such that the outer circumferential surface of the belt is exposed through a substantially rectangular opening between the two body portions.

10. A document deskewing module for a self-service bunch document depositing terminal, the document deskewing module comprising:

a set of sensors arranged to detect when a document transported in a first direction of document travel along a document transport path is deskewed;

a first set of drive rollers in the form of hard drive rollers disposed along the document transport path;

a first set of idler rollers moveable towards and away from the hard drive rollers;

a second set of drive rollers in the form of soft drive rollers disposed along the document transport path;

a second set of idler rollers moveable towards and away from the soft drive rollers;

a track bottom in the form of an endless continuous belt having an outer circumferential surface which extends along one side of the document transport path; and a controller arranged to (i) control operation of the first and second sets of idler rollers in response to a number of signals from the set of sensors such that a deskewed document is moved in a second direction of document travel which is transverse to the first direction of document travel, and (ii) control movement of the belt such that the outer circumferential surface of the belt moves a leading front corner of a deskewed document in the first direction of document travel when the corner moves into contact with the moving outer circumferential surface of belt as the document is moving in the second direction of document travel so as to reduce tendency of the corner of the document from curling and thereby to reduce tendency of the corner from bunching up and causing a document jam condition;

wherein the leading front corner of the document is moved by the moving outer circumferential surface of the endless belt in the first direction of document travel at a speed faster than the speed at which the document is being moved by the hard drive rollers in the first direction of document travel.

* * * * *